United States Patent [19]

Choi et al.

[11] Patent Number: 4,632,242

[45] Date of Patent: Dec. 30, 1986

[54] DISPLAY PACKAGE HAVING A RETRACTABLE HANGER

[75] Inventors: Kwang H. Choi, New York, N.Y.; Sun H. Hong, Seoul, Rep. of Korea

[73] Assignee: C. Itoh & Co. (America) Inc., New York, N.Y. ; by said Kwang H. Choi

[21] Appl. No.: 742,051

[22] Filed: Jun. 6, 1985

[51] Int. Cl.[4] ..... B65D 25/22

[52] U.S. Cl. ..... 206/45.34; 16/115; 206/461; 206/806; 220/94 R; 294/168

[58] Field of Search ..... 206/45.33, 45.34, 461, 206/462, 463, 466, 806, 468; 229/52 A; 16/115; 294/168; 220/94 R, 94 A

[56] References Cited

U.S. PATENT DOCUMENTS

| | | | |
|---|---|---|---|
| 337,412 | 3/1886 | Long | 16/115 |
| 401,832 | 4/1889 | Hartman | 16/115 |
| 468,639 | 2/1892 | Bryant | 16/115 |
| 1,496,326 | 6/1924 | Schulte | 206/806 X |
| 2,023,542 | 12/1935 | Peck | 206/806 X |
| 2,042,799 | 6/1936 | Ort | 206/806 X |
| 3,146,937 | 9/1964 | Vesak | 229/52 A |
| 3,258,152 | 6/1966 | Cameron | 229/52 A |
| 3,367,491 | 2/1968 | Dunham et al. | 206/468 |
| 4,020,947 | 5/1977 | Roccaforte | 206/806 X |
| 4,279,376 | 7/1981 | Roccaforte | 206/806 X |
| 4,347,930 | 9/1982 | Herrin | 206/45.34 |
| 4,349,102 | 9/1982 | Strongwater | 206/45.34 |

FOREIGN PATENT DOCUMENTS

| | | | |
|---|---|---|---|
| 2657395 | 6/1978 | Fed. Rep. of Germany | 206/806 X |

*Primary Examiner*—William Price
*Assistant Examiner*—Bryon Gehman
*Attorney, Agent, or Firm*—McAulay, Fields, Fisher, Goldstein & Nissen

[57] ABSTRACT

This disclosure is directed to a display package having a hanger disposed for sliding movement within a slot formed in the top wall of the container. The hanger has upper and lower tabs projecting outwardly from the sides of the hanger. The tabs are positioned and sized relative to the dimensions of the slot to limit movement of the hanger between a protracted position and an retracted position. The hanger further has a hook engaging opening positioned between the upper and lower tabs, and disposed to receive a hook to suspend the package for display when the hanger is in its protracted position.

12 Claims, 5 Drawing Figures

DISPLAY PACKAGE HAVING A RETRACTABLE HANGER

BACKGROUND OF THE INVENTION

This invention is directed generally to a display package, and more specifically, to a container having a retractable hanger disposed for sliding movement between a retracted position and a protracted position relative to the container.

It is known to construct a merchandise display package having a hanger fixedly connected to the top wall of the container and projecting upwardly therefrom to suspend the package from a supporting hook. Typically, the package is made of transparent plastic to permit visual display of the contents therein. A disadvantage of such packages resides in the fixedly connected hanger which, because of its relatively thin construction, and has a tendency to break off when in use or when the package is subjected to rough handling during shipment. Once the hanger is broken off, the package can only be displayed lying flat on a counter. However, this invites acts of theft by individuals intent on stealing the package. It is preferred that the display package be suspended from a support hook in plain view of store personnel rather than being stacked on a counter to reduce such incidences of theft.

Various attempts have been made in the past to provide containers and display packages with retractable handle or hanger members. Typical of such structures are U.S. Pat. Nos. 2,128,509; 3,146,937; 3,302,917; 3,380,575; 4,347,930; 4,349,102; and 4,373,632.

Of this grouping, U.S. Pat. Nos. 3,380,575; 4,347,930 and 4,349,102 each disclose a hanging package having a hanger which extends through an aperture in the top of the package to permit the package to be suspended from a supporting hook. In U.S. Pat. No. 3,380,575, the hanger is in the form of a display card which has an aperture for accommodating the hook. All three of these patents require that the hanger element first be positioned within the container prior to assembling the package. Further, the hangers have to be constructed with extended arms positioned at the lower portion thereof which are suitably sized relative to the openings in the top wall of the respective packages to prevent the hangers from being completly withdrawn from the respective containers when the hangers are in their retracted position. The aforesaid construction of the disclosed packages is expensive to manufacture and difficult to assemble.

The present invention provides a novel and unique display package which overcomes many of the disadvantages associated with the heretofore known package containers. In particular, the present package may be economically and simply manufactured. Further, the hanger element may be easily assembled to the container for movement between an inserted or retracted position to prevent the hanger from being broken off when not in use, and a withdrawn or protracted position to suspend the package from a supporting hook.

SUMMARY

The display package of this invention comprises a container having a top wall formed with a slot therein. A hanger is disposed in the slot for sliding movement therein relative to the container. The hanger is formed having a plurality of upper and lower lateral tabs projecting outwardly from opposite sides of the hanger.

The tabs are positioned and sized relative to the dimensions of the slot to limit movement of the hanger between a protracted position wherein the lower tabs engage the bottom surface of the container top wall to prevent complete withdrawal of the hanger from the container and a retracted position wherein the upper tabs engage the top surface of the container top wall to prevent complete insertion of the hanger in the container. The hanger further has a hook engaging opening positioned between the upper and lower tabs, and disposed to receive a hook to suspend the package for display when the hanger is in its protracted position.

The package further comprises a cover hinged to the container and disposed for pivotal movement away from the container to provide access to the interior of the package. Interconnecting snap closure members are provided on the cover and the container to close the package.

For a better understanding of the invention, and its various features and advantages, reference should be made to the following detailed description when taken in conjunction with the accompanying drawings.

DESCRIPTION OF THE PREFERRED EMBODIMENT

Figure 1:
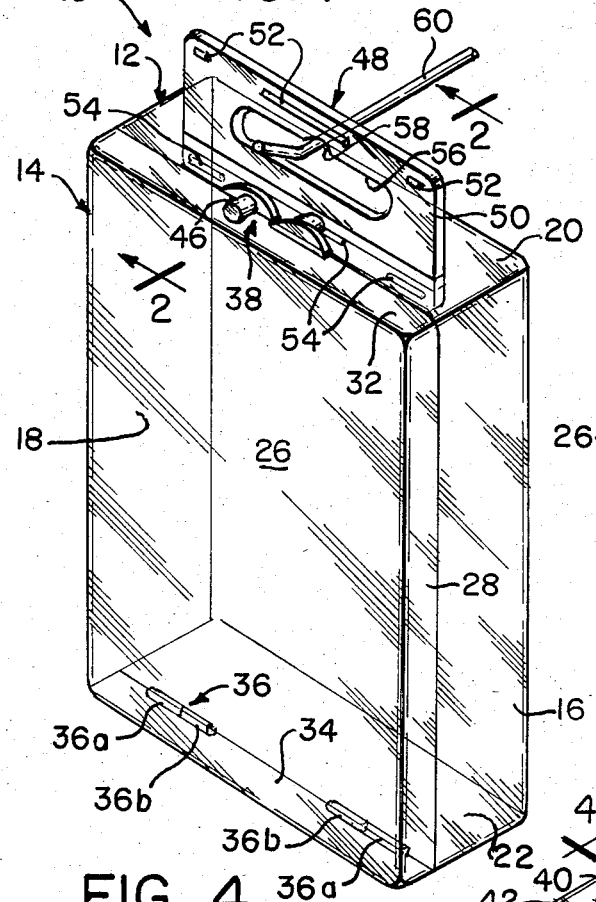
FIG. 1 is a perspective view of a display package embodying the present invention, with the hanger moved to its protracted position relative to the container to suspend the package from a supporting hook.

Referring to the drawings, there is shown a display package 10 constructed in accordance with the present invention. Package 10 includes two parts represented generally by container 12 and cover 14. Container 12 is formed having side walls 16 and 18, top wall 20, bottom wall 22, and a back wall 24. Each of said walls are integrally joined to form an enclosure for storing selected articles therein, such as nails, or the like. Top wall 20 is formed having an elongated slot 25 extending longitudinally therein for substantially the entire length of the wall. Slot 25 is sized and positioned to receive a hanger member for sliding movement therein in a manner hereinafter described.

Cover 14, similar to container 12, is formed having a front wall 26, side walls 28 and 30, top wall 32 and a bottom wall 34. Cover 14 is pivotally connected to container 12 by hinges indicated generally by numeral 36. Specifically, hinge elements **36*a* are formed integral with the bottom wall 34 of cover 14 and hinge elements 36*b* are formed integral with the bottom wall 22 of container 10. Each set of hinge elements 36*a* and 36*b* is formed with a cooperating pin-like projection and recess which interengage when the elements are snaped together. Hinges 36 permit pivotal movement of cover 14 in a direction toward container 12 to close the package 10, in a direction away from the container to permit access to the interior of package 10 and the contents thereof. The configuration of cover 14 is such that the end edges of cover walls 28–34 align with and abut against the corresponding end edges of container walls 16–22 when cover 14 is moved to a position of closure. Container 12 and cover 14 are made of plastic, and preferably, are transparent to permit the contents of package 10** to be seen when the package is closed.

A pair of interconnecting closure means, represented generally by numeral 38, are provided to secure cover 14 in a closed position relative to container 12. Specifically, closure means 38 comprises a pin 40 integrally formed with the top wall 32 of cover 14. Pin 40 is raised in the sense that its axis is located above the plane of wall 32 and is positioned parallel thereto. Pin 40 extends outwardly from the edge of wall 32 in a direction transverse to the longitudinal extent of said wall. The arrangement is such that when cover 14 is moved to its closed position, pin 40 overlies top wall 20 of container 12.

Closure means 38 further comprises a pair of raised ribs 42 projecting upwardly from top wall 20 of container 12. The positioning of ribs 42 along wall 20 and the spacing between said ribs is such as to frictionally receive therebetween pin 40 when cover 14 is in its closed position.

A similar interconnecting closure is provided by means of another pin 44 which projects outwardly from the edge of container top wall 20 and is frictionally received between a pair of raised ribs 46 on cover top wall 34. The interconnection of pins 40, 44 with respective ribs 42, 46 forms a double acting snap closure to retain cover 14 in its closed position until such time as the interconnecting elements are physically disengaged from one another to permit access to the contents of the package.

In accordance with the invention, a plastic hanger, represented generally by numeral 48, is positioned in slot 25 and is sized for sliding movement relative to container 12. Specifically, hanger 48 comprises an elongated plate 50 having length and width dimensions slightly less than the corresponding length and width dimenstions of slot 25.

Figure 2:
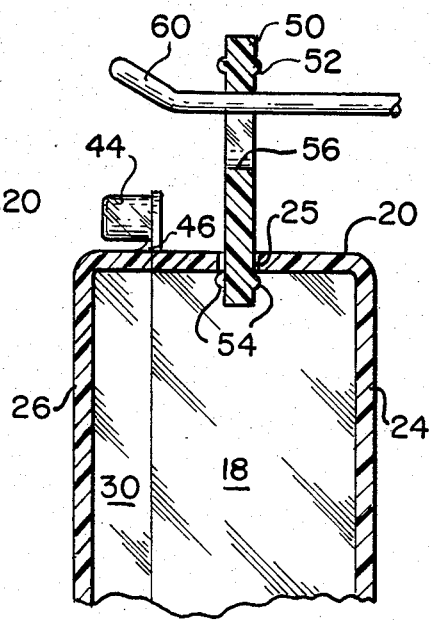
FIG. 2 is a partial cross-sectional view taken along line 2—2 of FIG. 1.
Figure 3:
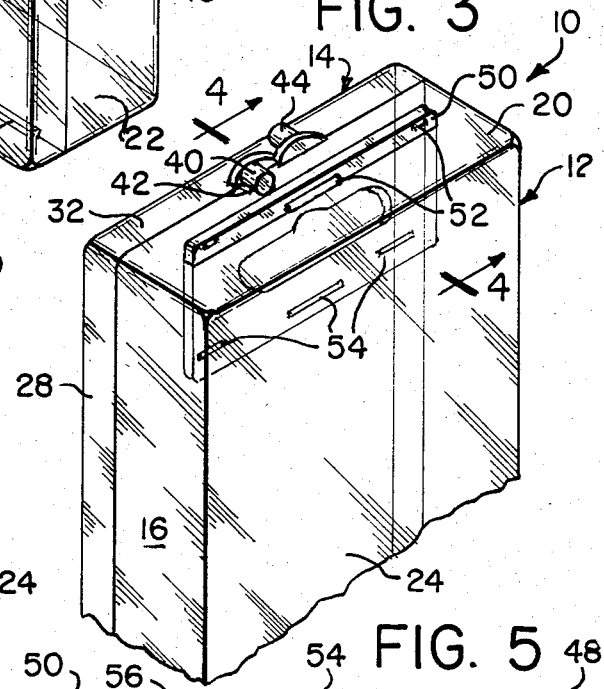
FIG. 3 is another perspective view of the display package of FIG. 1, with the hanger illustrated in its inserted position relative to the container.
Figure 4:
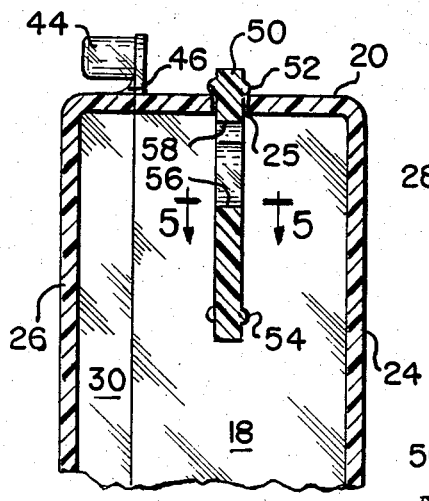
FIG. 4 is a cross-sectional view taken along line 4—4 of FIG. 3.
Figure 5:
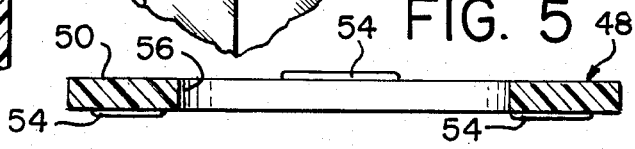
FIG. 5 is a cross-sectional view taken along line 5—5 of FIG. 4, with the orientation of the hanger rotated 90 degrees.

Plate 50 is formed having a plurality of upper lateral tabs 52 and lower lateral tabs 54 projecting outwardly from opposite sides of plate. Tabs 52 and 54 are positioned adjacent respective upper and lower edges of plate 50, and are spaced longitudinally along said plate. The combined width of plate 50 and the laterally projecting tabs is greater than the width of slot 25 such that the tabs 52, 54 engage portions of container top wall 20 upon sliding movement of hanger 48 within slot 25. Tabs 52, 54 thus serve to limit sliding movement of hanger 48 between a withdrawn or protracted position as shown in FIGS. 1 and 2 wherein lower tabs 54 engage the bottom surface of container top wall 20 to prevent complete withdrawal of hanger 48 from container 12, and an inserted or retracted position as shown in FIGS. 3 and 4 wherein the upper tabs 52 engage the top surface of wall 20 to prevent complete insertion of hanger 48 in the container.

Positioned on plate 50 between the upper and lower tabs 52, 54 is an elongated hook engaging opening 56 extending longitudinally along the plate. The upper edge of opening 56 is formed having a recess portion 58 adapted to position a hook 60 received therein to suspend package 10 from hook 60 for display when hanger 48 is in its protracted position as shown in FIGS. 1 and 2.

In assembly, plate 50 is positioned in slot 25 by having the lower tabs 54 through the slot. The structure is such to permit slight expansion of the slot in a transverse direction during the insertion of plate 50 without destroying the overall sizing relationship between hanger 48 and slot 25. Once hanger 48 is in position, the tabs 52, 54 function to limit movement of the hanger between it retracted and protracted positions under normal use.

Accordingly, there is provided a novel display package having a moveable hanger which may be slid to an inserted position to prevent the hanger from being broken off when the package is not in use, or when the package is being shipped fom one place to another. At such time as the package is to be suspended for display from a supporting structure, the hanger is easily slid to its retracted position to accomodate a supporting hook.

While the present invention has been described with respect to a particular embodiment, it will be readily appreciated and understood that numerous variations and modifications thereof may be made without departing from the spirit or scope of the claimed invention.

We claim:

1. A display package comprising:

a container having at least first and second side walls and a top wall, said top wall having a slot therein;

a hanger positioned in said slot and sized for sliding movement in said slot relative to said container;

said hanger having upper and lower tab means projecting outwardly thereof, said tab means being positioned and sized relative to the dimensions of said slot to limit movement of said hanger between (a) a protracted position wherein said lower tab means engage a bottom surface of said top wall to prevent complete withdrawal of said hanger from said container in normal use and (b) a retracted position wherein said upper tab means engage a top surface of said top wall to prevent complete insertion of said hanger in said container in normal use; and said hanger further having a hook engaging opening positioned between said upper and lower tab means to suspend the package for display when said hanger is in its protracted position.

2. The display package of claim 1, wherein said slot is elongated and extends longitudinally along said top wall; said hanger comprising an elongated plate having length and width dimensions slightly less than the corresponding length and width dimensions of said slot.

3. The display package of claim 2, wherein each of said upper and lower tab means comprises at least one lateral tab projecting outwardly from a side of said plate; the combined width of said plate and the lateral projection of said tab being greater than the width of said slot.

4. The display package of claim 3, wherein said upper and lower tab means comprise a plurality of lateral tabs projecting outwardly from opposite sides of said plate; said tabs being spaced longitudinally along said plate and projecting outwardly an amount to engage portions of said top wall upon sliding movement of said hanger to its protracted and retracted positions.

5. The display package of claim 4, wherein said upper and lower tabs are positioned adjacent respective upper and lower edges of said plate.

6. The display package of claim 1, wherein the upper edge of said hook engaging opening has a recess portion adapted to position the hook received within said opening.

7. The display package of claim 1, further comprising a bottom wall and a back wall which, together with said side walls and top wall, define the outer walls of said container; said package further comprising a cover hinged to said container and disposed for pivotal movement away from said container to provide access to the interior of said package; and interconnecting closure means on said cover and said container to close said package.

8. The display package of claim 7, wherein at least one portion of said package is transparent to permit the contents thereof to be seen when the package is closed.

9. A display package comprising:

a container having at least first and second side walls and a top wall, said top wall having an elongated slot extending longitudinally along said wall;

a hanger comprising an elongated plate having length and width dimensions slightly less than the corresponding length and width dimensions of said slot, said plate being positioned in said slot for sliding movement therein relative to said container;

said plate having a plurality of upper and lower lateral tabs spaced longitudinally along said plate and positioned adjacent respective upper and lower edges thereof, said tabs projecting outwardly from at least one of the sides of said plate by an amount to engage opposite portions of said top wall to limit sliding movement of said plate between (a) a protracted position wherein said lower tabs engage a bottom surface of said top wall to prevent complete withdrawal of said plate from said container in normal use and (b) a retracted position wherein said upper tabs engage a top surface of said top wall to prevent complete insertion of said plate in said container in normal use; and said plate further having an elongated hook engaging opening positioned between said upper and lower tabs, the upper edge of said hook engaging opening having a recess portion adapted to position the hook received in said opening to suspend the package for display when said hanger is in its protracted position.

10. The display package of claim 9, wherein the upper edge of said hook engaging opening has a recess portion adapted to position the hook received within said opening.

11. The display package of claim 9, further comprising a bottom wall and a back wall which, together with said side walls and top wall, define the outer walls of said container; said package further comprising a cover hinged to said container and disposed for pivotal movement toward said container to close said package and away from said container to provide access to the interior of said package; at least one portion of said package being transparent to permit the contents thereof to be seen when the package is closed; and interconnecting closure means on said cover and said container to close said package.

12. The display package of claim 11, wherein at least one portion of said package is transparent to permit the contents thereof to be seen when the package is closed.

* * * * *